US007648621B2

(12) United States Patent
Aiba et al.

(10) Patent No.: US 7,648,621 B2
(45) Date of Patent: Jan. 19, 2010

(54) COPPER ELECTROPLATING METHOD, PURE COPPER ANODE FOR COPPER ELECTROPLATING, AND SEMICONDUCTOR WAFER PLATED THEREBY WITH LITTLE PARTICLE ADHESION

(75) Inventors: Akihiro Aiba, Ibaraki (JP); Takeo Okabe, Ibaraki (JP); Junnosuke Sekiguchi, Ibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 626 days.

(21) Appl. No.: 10/486,078

(22) PCT Filed: Sep. 5, 2002

(86) PCT No.: PCT/JP02/09014

§ 371 (c)(1),
(2), (4) Date: Feb. 6, 2004

(87) PCT Pub. No.: WO03/048429

PCT Pub. Date: Jun. 12, 2003

(65) Prior Publication Data

US 2004/0200727 A1 Oct. 14, 2004

(30) Foreign Application Priority Data

Dec. 7, 2001 (JP) ..... 2001-374212

(51) Int. Cl.
*C25D 3/38* (2006.01)

(52) U.S. Cl. ..... 205/157

(58) Field of Classification Search ..... 205/157
See application file for complete search history.

(56) References Cited

U.S. PATENT DOCUMENTS 2,923,671 A * 2/1960 Tilburg ..... 205/292
3,691,031 A * 9/1972 Lugscheider ..... 205/209
4,696,729 A * 9/1987 Santini ..... 204/224 R
5,147,466 A * 9/1992 Ohmori et al. ..... 134/7
6,372,119 B1 * 4/2002 Ray et al. ..... 205/387
6,451,135 B1 * 9/2002 Takahashi et al. ..... 148/432
6,531,039 B2 3/2003 Kohut ..... 204/292
6,562,222 B1 5/2003 Sekiguchi et al. ..... 205/296
2002/0000371 A1 1/2002 Mishima et al. ..... 204/199
2004/0007474 A1 1/2004 Okabe et al. ..... 205/292
2004/0149588 A1 8/2004 Aiba et al. ..... 205/292

FOREIGN PATENT DOCUMENTS

JP 2001-240949 * 9/2001

OTHER PUBLICATIONS

Lamontagne et al., "Effect of Oxygen on the Cu-Cu2Se-Ag System", Apr. 1, 1999, Department of Metallurgy and Materials Science, University of Toronto, p. 1444.*

Patent Abstracts of Japan, 1 page English Abstract of JP 2001-240949, Sep. 2001.

* cited by examiner

*Primary Examiner*—Roy King
*Assistant Examiner*—Jessee R. Roe
(74) *Attorney, Agent, or Firm*—Howson & Howson LLP

(57) ABSTRACT

The present invention pertains to an electrolytic copper plating method characterized in employing pure copper as the anode upon performing electrolytic copper plating, and performing electrolytic copper plating with the pure copper anode having a crystal grain diameter of 10 μm or less or 60 μm or more or a non-recrystallized anode. Provided are an electrolytic copper plating method and a pure copper anode for electrolytic copper plating used in such electrolytic copper plating method capable of suppressing the generation of particles such as sludge produced on the anode side within the plating bath upon performing electrolytic copper plating, and capable of preventing the adhesion to a semiconductor wafer, as well as a semiconductor wafer plated with the foregoing method and anode having low particle adhesion.

9 Claims, 1 Drawing Sheet

COPPER ELECTROPLATING METHOD, PURE COPPER ANODE FOR COPPER ELECTROPLATING, AND SEMICONDUCTOR WAFER PLATED THEREBY WITH LITTLE PARTICLE ADHESION

BACKGROUND OF THE INVENTION

The present invention pertains to an electrolytic copper plating method and a pure copper anode used in such electrolytic copper plating method capable of suppressing the generation of particles such as sludge produced on the anode side within the plating bath upon performing electrolytic copper plating, and in particular capable of preventing the adhesion of particles to a semiconductor wafer, as well as to a semiconductor wafer having low particle adhesion plated with the foregoing method and anode.

Generally, although an electrolytic copper plate has been employed for forming copper wiring in a PWB (print wiring board) or the like, in recent years, it is being used for forming copper wiring of semiconductors. An electrolytic copper plate has a long history, and it has reached its present form upon accumulating numerous technical advancements. Nevertheless, when employing this electrolytic copper plate for forming copper wiring of semiconductors, a new problem arose which was not found in a PWB.

Ordinarily, when performing electrolytic copper plating, phosphorous copper is used as the anode. This is because when an insoluble anode formed from the likes of platinum, titanium, or iridium oxide is used, the additive within the plating liquid would decompose upon being affected by anodic oxidization, and inferior plating will occur thereby. Moreover, when employing electrolytic copper or oxygen-free copper of a soluble anode, a large amount of particles such as sludge is generated from metallic copper or copper oxide caused by the dismutation reaction of monovalent copper during dissolution, and the plating object will become contaminated as a result thereof.

On the other hand, when employing a phosphorous copper anode, a black film composed of phosphorous copper or copper chloride is formed on the anode surface due to electrolysis, and it is thereby possible to suppress the generation of metallic copper or copper oxide caused by the dismutation reaction of monovalent copper, and to control the generation of particles.

Nevertheless, even upon employing phosphorous copper as the anode as described above, it is not possible to completely control the generation of particles since metallic copper or copper oxide is produced where the black film drops off or at portions where the black film is thin.

In light of the above, a filter cloth referred to as an anode bag is ordinarily used to wrap the anode so as to prevent particles from reaching the plating liquid.

Nevertheless, when this kind of method is employed, particularly in the plating of a semiconductor wafer, there is a problem in that minute particles, which were not a problem in forming the wiring of a PWB and the like, reach the semiconductor wafer, such particles adhere to the semiconductor, and thereby cause inferior plating.

As a result, when employing phosphorous copper as the anode, it became possible to significantly suppress the generation of particles by adjusting the phosphorous content, which is a component of phosphorous copper, electroplating conditions such as the current density, crystal grain diameter and so on.

Nevertheless, when the phosphorous copper anode dissolves, since phosphorous elutes simultaneously with copper in the solution, a new problem arose in that the plating solution became contaminated by the phosphorous. Although this phosphorous contamination occurred in the plating process of conventional PWB as well, as with the foregoing cases, it was not much of a problem. However, since the copper wiring of semiconductors and the like in particular disfavor eutectoid and inclusion of impurities, phosphorous accumulation in the solution was becoming a major problem.

SUMMARY OF THE INVENTION

The present invention aims to provide an electrolytic copper plating method and a pure copper anode used in such electrolytic copper plating method capable of suppressing the generation of particles such as sludge produced on the anode side within the plating bath upon performing electrolytic copper plating, without using phosphorous copper, and in particular capable of preventing the adhesion of particles to a semiconductor wafer, as well as to a semiconductor wafer having low particle adhesion plated with the foregoing method and anode.

In order to achieve the foregoing object, as a result of intense study, the present inventors discovered that a semiconductor wafer and the like having low particle adhesion can be manufactured stably by improving the electrode material, and suppressing the generation of particles in the anode.

Based on the foregoing discovery, the present invention provides an electrolytic copper plating method characterized in employing pure copper as the anode upon performing electrolytic copper plating, and performing electrolytic copper plating with said pure copper anode which has a crystal grain diameter of less than 10 μm or 60 μm or more or more preferably, 5 μm or less or 100 μm or more. Preferably, the pure copper has a purity of 2N (99 wt %) or higher, excluding gas components, or more preferably, 3N (99.9 wt %) to 6N (99.9999 wt %), excluding gas components. Preferably, the pure copper has an oxygen content of 500 to 15000 ppm or more preferably, 1000 to 10000 ppm. The present invention also relates to a pure copper anode for performing electrolytic copper plating characterized in that said anode is used for performing electrolytic copper plating, pure copper is used as the anode, and the crystal grain diameter of said pure anode is less than 10 μm or 60 μm or more or more preferably, 5 μm or less or 100 μm or more. Preferably, the pure copper has a purity of 2N (99 wt %) or higher, excluding gas components, or more preferably, 3N (99.9 wt %) to 6N (99.9999 wt %), excluding gas components. Preferably, the pure copper has an oxygen content of 500 to 15000 ppm, or more preferably, 1000 to 10000 ppm. Preferably, the electrolytic copper plating is performed on a semiconductor wafer, and preferably, a semiconductor wafer having low particle adhesion is provided.

DETAILED DESCRIPTION OF THE INVENTION

Figure 1:
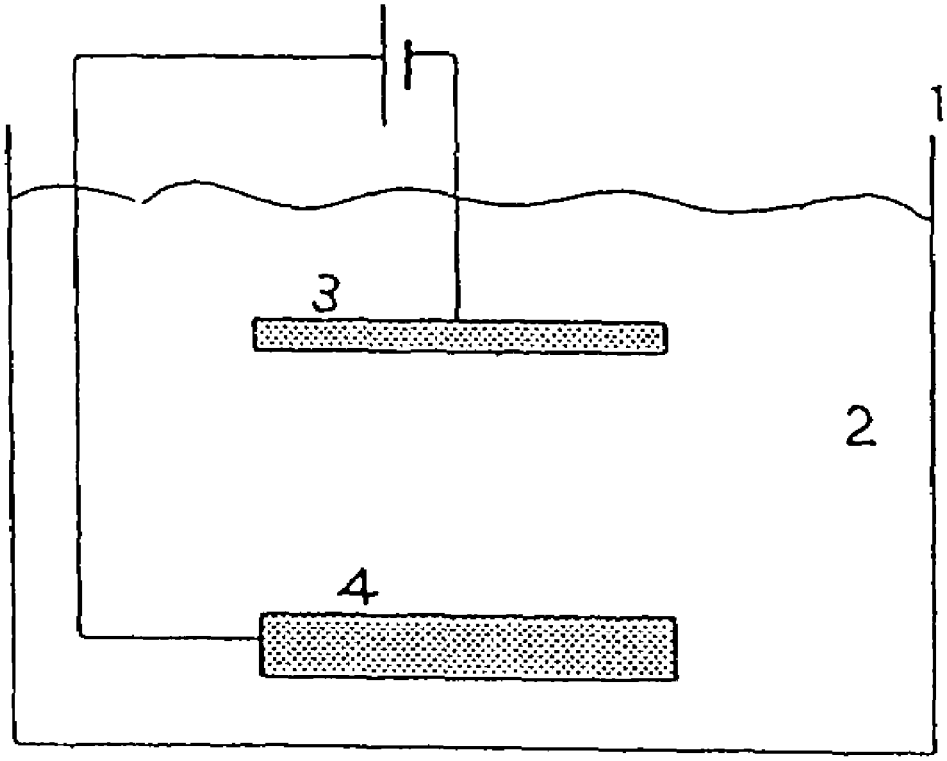
FIG. 1 is a conceptual diagram of a device used in the electrolytic copper plating method of a semiconductor wafer according to the present invention.

FIG. 1 is a diagram illustrating an example of the device employed in the electrolytic copper plating method of a semiconductor wafer. The copper plating device is equipped with the plating bath 1 containing copper sulfate plating liquid 2. A pure copper anode 4 is used as the anode, and, as the cathode 3, for example, a semiconductor wafer is used as the object of plating.

Conventionally, when employing pure copper as the anode upon performing electrolytic plating, it has been said that particles such as sludge composed of metallic copper or copper oxide caused by the dismutation reaction of monovalent copper during the dissolution of the anode would be generated.

Nevertheless, it has been discovered that the generation of particles in the anode could be suppressed by suitably controlling the particle size, purity, oxygen content and the like of the pure copper anode, and that the production of defective goods during the semiconductor manufacture process can be reduced by preventing the adhesion of particles to the semiconductor wafer.

Moreover, since a phosphorous copper anode is not used, there is a superior characteristic in that phosphorous will not accumulate in the plating bath, and phosphorous will therefore not contaminate the semiconductor.

Specifically, pure copper is employed as the anode, and electrolytic copper plating is performed with such pure copper anode having a crystal grain diameter of less than 10 μm or 60 μm or more. If the crystal grain diameter of the pure copper anode exceeds 10 μm or is less than 60 μm, as indicated in the Examples and Comparative Examples described later, the generation of sludge will increase.

In a particularly preferable range, the crystal grain diameter is 5 μm or less or 100 μm or more.

With respect to purity, pure copper having a purity of 2N (99 wt %) or higher, excluding gas components, is used as the anode. Generally, pure copper having a purity of 3N (99.9%) to 6N (99.9999 wt %), excluding gas components, is used as the anode.

Further, employing pure copper having an oxygen content of 500 to 15000 ppm as the anode is desirable since the generation of sludge can be suppressed and particles can be reduced. In particular, regarding the copper oxide in the anode, dissolution of the anode is smoother in the form of CuO in comparison to $Cu_2O$, and the generation of sludge tends to be less. More preferably, the oxygen content is 1000 to 10000 ppm.

As a result of performing electrolytic copper plating with the pure copper anode of the present invention as described above, the generation of sludge or the like can be reduced significantly, and it is further possible to prevent particles from reaching the semiconductor wafer and causing inferior plating upon such particles adhering to the semiconductor wafer.

The electrolytic plate employing the pure copper anode of the present invention is particularly effective in the plating of a semiconductor wafer, but is also effective for copper plating in other sectors where fine lines are on the rise, and may be employed as an effective method for reducing the inferior ratio of plating caused by particles.

As described above, the pure copper anode of the present invention yields an effect of suppressing the irruption of particles such as sludge composed of metallic copper or copper oxide, and significantly reducing the contamination of the object to be plated, but does not cause the decomposition of additives within the plating liquid or inferior plating resulting therefrom which occurred during the use of insoluble anodes in the past.

As the plating liquid, an appropriate amount of copper sulfate: 10 to 70 g/L (Cu), sulfuric acid: 10 to 300 g/L, chlorine ion 20 to 100 mg/L, additive: (CC-1220: 1 mL/L or the like manufactured by Nikko Metal Plating) may be used. Moreover, it is desirable that the purity of the copper sulfate be 99.9% or higher.

In addition, it is desirable that the plating temperature is 15 to 40° C., cathode current density is 0.5 to 10 A/dm$^2$, and anode current density is 0.5 to 10 A/dm$^2$. Although the foregoing plating conditions represent preferable examples, it is not necessary to limit the present invention to the conditions described above.

EXAMPLES AND COMPARATIVE EXAMPLES

Next, the Examples of the present invention are explained. Further, these Examples are merely illustrative, and the present invention shall in no way be limited thereby. In other words, the present invention shall include all other modes or modifications other than these Examples within the scope of the technical spirit of this invention.

Examples 1 to 4

Pure copper having a purity of 4N to 5N was used as the anode, and a semiconductor wafer was used as the cathode. As shown in Table 2, with respect to the crystal grain size of these pure copper anodes, anodes adjusted respectively to 5 μm, 500 μm, and 2000 μm were used.

Further, the oxygen content of each of the foregoing anodes was less than 10 ppm. The analysis of the 4N pure copper anode is shown in Table 1.

As the plating liquid, copper sulfate: 50 g/L (Cu), sulfuric acid: 10 g/L, chlorine ion 60 mg/L, additive [brightening agent, surface active agent] (Product Name CC-1220: manufactured by Nikko Metal Plating): 1 mL/L were used. The purity of the copper sulfate within the plating liquid was 99.99%.

The plating conditions were plating temperature 30° C., cathode current density 4.0 A/dm$^2$, anode current density 4.0 A/dm$^2$, and plating time 12 hr. The foregoing conditions and other conditions are shown in Table 2.

TABLE 1

Analysis of 4N Pure Copper Anode

| Element | Concentration ppm |
|---|---|
| Li | <0.001 |
| Be | <0.001 |
| B | <0.001 |
| F | <0.01 |
| Na | <0.01 |
| Mg | <0.001 |
| Al | 0.006 |
| Si | 0.06 |
| P | 0.24 |
| S | 11 |
| Cl | 0.02 |
| K | <0.01 |
| Ca | <0.005 |
| Sc | <0.001 |
| Ti | <0.001 |
| V | <0.001 |
| Cr | 0.06 |
| Mn | 0.02 |
| Fe | 0.54 |
| Co | 0.002 |
| Ni | 0.91 |
| Cu | Matrix |
| Zn | <0.05 |
| Ga | <0.01 |
| Ge | <0.005 |
| As | 0.21 |
| Se | 0.35 |
| Br | <0.05 |
| Rb | <0.001 |
| Sr | <0.001 |

TABLE 1-continued

| Analysis of 4N Pure Copper Anode | |
|---|---|
| Element | Concentration ppm |
| Y | <0.001 |
| Zr | <0.001 |
| Nb | <0.005 |
| Mo | 0.01 |
| Ru | <0.005 |
| Rh | <0.05 |
| Pd | <0.005 |
| Ag | 10 |
| Cd | <0.01 |
| In | <0.005 |
| Sn | 0.07 |
| Sb | 0.16 |
| Te | 0.14 |
| I | <0.005 |
| Cs | <0.005 |
| Ba | <0.001 |
| La | <0.001 |
| Ce | <0.001 |
| Pr | <0.001 |
| Nd | <0.001 |
| Sm | <0.001 |
| Eu | <0.001 |
| Gd | <0.001 |
| Tb | <0.001 |
| Dy | <0.001 |
| Ho | <0.001 |
| Er | <0.001 |
| Tm | <0.001 |
| Yb | <0.001 |
| Lu | <0.001 |
| Hf | <0.001 |
| Ta | <5 |
| W | <0.001 |
| Re | <0.001 |
| Os | <0.001 |
| Ir | <0.001 |

TABLE 1-continued

| Analysis of 4N Pure Copper Anode | |
|---|---|
| Element | Concentration ppm |
| Pt | <0.01 |
| Au | <0.01 |
| Hg | <0.01 |
| Tl | <0.001 |
| Pb | 0.71 |
| Bi | 0.11 |
| Th | <0.0001 |
| U | <0.0001 |
| C | <10 |
| N | <10 |
| O | <10 |
| H | <1 |

After the plating, the generation of particles, plate appearance and embeddability were observed. The results are similarly shown in Table 2.

Regarding the particle amount, after having performed electrolysis under the foregoing electrolytic conditions, the plating liquid was filtered with a filter of 0.2 μm, and the weight of the filtrate was measured thereby. Regarding the plate appearance, after having performed electrolysis under the foregoing electrolytic conditions, the object to be plated was exchanged, plating was conducted for 1 minute, and the existence of burns, clouding, swelling, abnormal deposition, foreign material adhesion and so on were observed visually. Regarding embeddability, the embeddability of the semiconductor wafer via having an aspect ratio of 5 (via diameter 0.2 μm) was observed in its cross section with an electronic microscope.

As a result of the foregoing experiments, the amount of particles was 3030 to 3857 mg in Examples 1 to 4, and the plate appearance and embeddability were favorable.

TABLE 2

| | | Examples | | |
|---|---|---|---|---|
| | | 1 | 2 | 4 |
| Anode | Crystal Grain Size (μm) | 5 μm | 5000 μm | 2000 μm |
| | Purity | 4N | 4N | 5N |
| | Oxygen Content | <10 ppm | <10 ppm | <10 ppm |
| Plating Liquid | Metallic Salt | Copper Sulfate: 50 g/L (Cu) | Copper Sulfate: 50 g/L (Cu) | Copper Sulfate: 50 g/L (Cu) |
| | Acid | Sulfuric Acid: 10 g/L | Sulfuric Acid: 10 g/L | Sulfuric Acid: 10 g/L |
| | Chlorine Ion (ppm) | 60 | 60 | 60 |
| | Additive | CC-1220: 1 mL/L (Nikko Metal Plating) | CC-1220: 1 mL/L (Nikko Metal Plating) | CC-1220: 1 mL/L (Nikko Metal Plating) |
| Electrolytic Conditions | Bath Amount (mL) | 700 | 700 | 700 |
| | Bath Temperature (° C.) | 30 | 30 | 30 |
| | Cathode | Semiconductor Wafer | Semiconductor Wafer | Semiconductor Wafer |
| | Cathode Area ($dm^2$) | 0.4 | 0.4 | 0.4 |
| | Anode Area ($dm^2$) | 0.4 | 0.4 | 0.4 |
| | Cathode Current Density ($A/dm^2$) | 4.0 | 4.0 | 4.0 |
| | Anode Current Density ($A/dm^2$) | 4.0 | 4.0 | 4.0 |
| | Time (h) | 12 | 12 | 12 |
| Evaluation Results | Particle Amount (mg) | 3857 | 3116 | 3574 |
| | Plate Appearance | Favorable | Favorable | Favorable |
| | Embeddability | Favorable | Favorable | Favorable |

Regarding the particle amount, after having performed electrolysis under the foregoing electrolytic conditions, the plating liquid was filtered with a filter of 0.2 μm, and the weight of the filtrate was measured thereby.
Regarding the plate appearance, after having performed electrolysis under the foregoing electrolytic conditions, the semiconductor wafer was replaced, plating was performed for 1 min., and the existence of burns, clouding, swelling, abnormal deposition and the like was observed visually.
Regarding embeddability, the embeddability of semiconductor wafer via having an aspect ratio of 5 (via diameter 0.2 μm) was observed in its cross section with an electronic microscope.

Example 6

As shown in Table 3, pure copper having a purity of 4N to 5N was used as the anode, and a semiconductor wafer was used as the cathode. The crystal grain size of these pure copper anodes was 2000 μm.

As the plating liquid, copper sulfate: 50 g/L (Cu), sulfuric acid: 10 g/L, chlorine ion 60 mg/L, additive [brightening agent, surface active agent] (Product Name CC-1220: manufactured by Nikko Metal Plating): 1 mL/L were used. The purity of the copper sulfate within the plating liquid was 99.99%.

The plating conditions were plating temperature 30° C., cathode current density 4.0 A/dm$^2$, anode current density 4.0 A/dm$^2$, and plating time 12 hr.

With the foregoing Example 6, in particular, illustrated is an example in which the oxygen content was 4000 ppm. The foregoing conditions and other conditions are shown in Table 3.

After the plating, the generation of particles, plate appearance and embeddability were observed. The results are similarly shown in Table 3. Moreover, the observation of the amount of particles, plate appearance and embeddability was pursuant to the same method as with foregoing Examples 1 to 4.

As a result of the foregoing experiments, the amount of particles was 188 mg in Example 6, and the plate appearance and embeddability were favorable. In particular, although the foregoing Example contained a prescribed amount of oxygen as described above, even in comparison to Examples 1 and 4, the reduction in the amount of particles can be acknowledged.

Accordingly, it is evident that containing an adjusted amount of oxygen in the pure copper anode is effective in forming a stable plate coating without any particles.

Comparative Example 1 and 2

As shown in Table 3, pure copper having a crystal grain diameter of 30 μm was used as the anode, and a semiconductor wafer was used as the cathode. Regarding the purity of these copper anodes, pure copper of 4N and 5N of the same level as the Examples was used. Moreover, each of the anodes used has an oxygen content of less than 10 ppm.

As the plating liquid, copper sulfate: 50 g/L (Cu), sulfuric acid: 10 g/L, chlorine ion 60 mg/L, additive [brightening agent, surface active agent] (Product Name CC-1220: manufactured by Nikko Metal Plating): 1 mL/L were used. The purity of the copper sulfate within the plating liquid was 99.99%.

The plating conditions were plating temperature 30° C., cathode current density 4.0 A/dm$^2$, anode current density 4.0 A/dm$^2$, and plating time 12 hr. The foregoing conditions and other conditions are shown in Table 3.

After the plating, the generation of particles, plate appearance and embeddability were observed. The results are similarly shown in Table 3.

Moreover, the observation of the amount of particles, plate appearance and embeddability was pursuant to the same method as with the foregoing Examples. As a result of the foregoing experiments, the amount of particles in Comparative Examples 1 and 2 reached 6540 to 6955 mg, and although the embeddability was favorable, the plate appearance was unfavorable.

Accordingly, it has been confirmed that the crystal grain size of the pure copper anode significantly influences the generation of particles, and, by adding oxygen thereto, the generation of particles can be further suppressed.

The present invention yields a superior effect in that upon performing electrolytic plating, it is capable of suppressing

TABLE 3

| | | Examples | Comparative Examples | |
|---|---|---|---|---|
| | | 6 | 1 | 2 |
| Anode | Crystal Grain Size (μm) | 2000 μm | 30 μm | 30 μm |
| | Purity | 5N | 4N | 5N |
| | Oxygen Content | 4000 ppm | <10 ppm | <10 ppm |
| Plating Liquid | Metallic Salt | Copper Sulfate: 50 g/L (Cu) | Copper Sulfate: 50 g/L (Cu) | Copper Sulfate: 50 g/L (Cu) |
| | Acid | Sulfuric Acid: 10 g/L | Sulfuric Acid: 10 g/L | Sulfuric Acid: 10 g/L |
| | Chlorine Ion (ppm) | 60 | 60 | 60 |
| | Additive | CC-1220: 1 mL/L (Nikko Metal Plating) | CC-1220: 1 mL/L (Nikko Metal Plating) | CC-1220: 1 mL/L (Nikko Metal Plating) |
| Electrolytic Conditions | Bath Amount (mL) | 700 | 700 | 700 |
| | Bath Temperature (° C.) | 30 | 30 | 30 |
| | Cathode | Semiconductor Wafer | Semiconductor Wafer | Semiconductor Wafer |
| | Cathode Area (dm$^2$) | 0.4 | 0.4 | 0.4 |
| | Anode Area (dm$^2$) | 0.4 | 0.4 | 0.4 |
| | Cathode Current Density (A/dm$^2$) | 4.0 | 4.0 | 4.0 |
| | Anode Current Density (A/dm$^2$) | 4.0 | 4.0 | 4.0 |
| | Time (h) | 12 | 12 | 12 |
| Evaluation Results | Particle Amount (mg) | 188 | 6540 | 6955 |
| | Plate Appearance | Favorable | Unfavorable | Unfavorable |
| | Embeddability | Favorable | Favorable | Favorable |

Regarding the particle amount, after having performed electrolysis under the foregoing electrolytic conditions, the plating liquid was filtered with a filter of 0.2 μm, and the weight of the filtrate was measured thereby.

Regarding the plate appearance, after having performed electrolysis under the foregoing electrolytic conditions, the semiconductor wafer was replaced, plating was performed for 1 min., and the existence of burns, clouding, swelling, abnormal deposition and the like was observed visually.

Regarding embeddability, the embeddability of semiconductor wafer via having an aspect ratio of 5 (via diameter 0.2 μm) was observed in its cross section with an electronic microscope.

the generation of particles such as sludge produced on the anode side within the plating bath, and capable of significantly preventing the adhesion of particles to a semiconductor wafer.

The invention claimed is:

1. An anode for performing electrolytic copper plating comprising an electrolytic copper plating copper anode having a purity, crystal grain diameter, and oxygen content that enables said copper anode to inhibit generation of sludge in an electrolytic copper plating bath containing a copper sulfate plating liquid, said purity being 3N (99.9 wt %) to 6N (99.9999 wt %), excluding gas components, and said crystal grain diameter being 5 μm or less.

2. An anode according to claim 1, wherein said purity of said copper anode is 4N (99.99 wt %), excluding gas components, and said oxygen content is less than 10 ppm.

3. An anode according to claim 1, wherein said purity of said copper anode is 4N (99.99 wt %) to 5N (99.999 wt %), excluding gas components.

4. An anode according to claim 3, wherein said oxygen content is less than 10 ppm.

5. An assembly for performing electrolytic copper plating, comprising a plating bath containing a copper sulfate plating liquid and an anode and cathode submerged in said plating liquid within said plating bath, said anode comprising a copper anode having a purity, crystal grain diameter, and oxygen content that enables said copper anode to inhibit generation of sludge during electroplating, said crystal grain diameter being 5 μm or less and said purity of said copper anode being 3N (99.9 wt %) to 6N (99.9999 wt %), excluding gas components.

6. An assembly according to claim 5, wherein said cathode is a semiconductor wafer.

7. An assembly according to claim 5, wherein said purity of said copper anode is 4N (99.99 wt %), excluding gas components, and said oxygen content is less than 10 ppm.

8. An assembly according to claim 5, wherein said purity of said copper anode is 4N (99.99 wt %) to 5N (99.999 wt %), excluding gas components.

9. An assembly according to claim 8, wherein said oxygen content is less than 10 ppm.

* * * * *

UNITED STATES PATENT AND TRADEMARK OFFICE

CERTIFICATE OF CORRECTION

PATENT NO. : 7,648,621 B2
APPLICATION NO. : 10/486078
DATED : January 19, 2010
INVENTOR(S) : Aiba et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1173 days.

Signed and Sealed this

Twenty-eighth Day of December, 2010

David J. Kappos

David J. Kappos
*Director of the United States Patent and Trademark Office*